US006625905B2

(12) United States Patent
Kita

(10) Patent No.: US 6,625,905 B2
(45) Date of Patent: Sep. 30, 2003

(54) MIDSOLE STRUCTURE OF ATHLETIC SHOE

(75) Inventor: Kenjiro Kita, Osaka (JP)

(73) Assignee: Mizuno Corporation, Osaka (JP)

( * ) Notice: Subject to any disclaimer, the term of this patent is extended or adjusted under 35 U.S.C. 154(b) by 0 days.

(21) Appl. No.: 09/943,869

(22) Filed: Aug. 31, 2001

(65) Prior Publication Data

US 2003/0000109 A1 Jan. 2, 2003

(30) Foreign Application Priority Data

Jun. 28, 2001 (JP) ..... 2001-196689

(51) Int. Cl.[7] ..... A43B 13/18
(52) U.S. Cl. ..... 36/30 R; 36/28; 36/25 R
(58) Field of Search ..... 36/28, 29, 30 R, 36/31, 25 R

(56) References Cited

U.S. PATENT DOCUMENTS

| | | | | |
|---|---|---|---|---|
| 1,050,807 A | | 1/1913 | Chamberlain | |
| 2,237,190 A | * | 4/1941 | McLeod | 36/29 |
| 2,275,720 A | * | 3/1942 | Bingham, Jr. | 36/30 R |
| 2,364,134 A | | 12/1944 | Dow et al. | |
| 2,677,906 A | | 5/1954 | Reed | |
| 4,356,642 A | | 11/1982 | Herman | |
| 4,523,393 A | * | 6/1985 | Inohara | 36/29 |
| 4,561,195 A | | 12/1985 | Onoda et al. | |
| 4,774,774 A | | 10/1988 | Allen, Jr. | |
| 4,798,010 A | | 1/1989 | Sugiyama | |
| 4,805,319 A | | 2/1989 | Tonkel | |
| 4,864,737 A | | 9/1989 | Marrello | |
| 4,910,882 A | | 3/1990 | Göller | |
| 4,999,931 A | | 3/1991 | Vermeulen | |
| 5,185,943 A | | 2/1993 | Tong et al. | |
| 5,606,807 A | | 3/1997 | Prepodnik | |
| 5,720,118 A | | 2/1998 | Mayer et al. | |
| 5,799,415 A | | 9/1998 | Kenji et al. | |
| 6,205,681 B1 | | 3/2001 | Kita | |
| 6,289,608 B1 | * | 9/2001 | Kita et al. | 36/28 |
| 6,311,414 B1 | | 11/2001 | Kita | |
| 6,338,206 B1 | * | 1/2002 | Kita | 36/29 |
| 6,389,713 B1 | * | 5/2002 | Kita | 36/28 |

FOREIGN PATENT DOCUMENTS

| | | |
|---|---|---|
| EP | 0857434 | 8/1998 |
| GB | 2032760 | 5/1980 |
| JP | 61-6804 | 3/1986 |
| JP | 11-203 | 1/1999 |
| JP | 11-346803 | 12/1999 |
| WO | WO90/06699 | 6/1990 |

* cited by examiner

*Primary Examiner*—Marie D Patterson
(74) *Attorney, Agent, or Firm*—W. F. Fasse; W. G. Fasse

(57) ABSTRACT

A midsole structure of an athletic shoe includes an upper midsole (3) formed of a soft elastic material and extending from a heel region to a forefoot region of the shoe, lower midsoles (4, 5) each formed of a soft elastic material and disposed at the heel region and the forefoot region under the upper midsole (3), and first and second corrugated sheets (6, 7) disposed opposite to each other between the upper midsole (3) and the lower midsoles (4, 5). Through holes (10, 11) are provided at the heel region and the midfoot region of the shoe. The through holes (10, 11) are bounded between the respective facing corrugated surfaces of the first and second corrugated sheets (6, 7). The through hole (11) provided at the midfoot region has an oblong and elongated shape in cross section.

18 Claims, 5 Drawing Sheets

MIDSOLE STRUCTURE OF ATHLETIC SHOE

BACKGROUND OF THE INVENTION

The present invention relates to a midsole structure of an athletic shoe, and more particularly, a midsole assembly having a corrugated sheet therein.

A sole for an athletic shoe used in various sports includes a midsole formed of a soft elastic material to secure cushioning properties and an outsole fitted to the bottom surface of the midsole and directly contacting the ground.

Not only cushioning properties but also running stability are required of an athletic shoe. That is, there is a need to prevent over-pronation or over-supination that causes an excessive lateral or transverse deformation of a shoe sole after striking onto the ground.

As shown in Japanese utility model application publication No. 61-6804 and Japanese patent application laying-open publication No. 11-203, Mizuno Corporation proposed a midsole assembly having a corrugated sheet therein to prevent such an excessive lateral or transverse deformation.

In the midsole assembly described in the above-mentioned publications, a corrugated sheet having a wavy corrugation is disposed in a heel portion of a midsole. Therefore, at the time of striking onto the ground, a resistance force occurs to restrain lateral or transverse deformation of the heel portion of the midsole and thus, running stability is achieved.

By inserting a corrugated sheet into a midsole heel portion, the midsole heel portion tends to be less deformed in the lateral or transverse direction and running stability is improved, but especially in the case of using a corrugated sheet formed of a high elastic material, the midsole heel portion becomes less deformed in the vertical direction as well and cushioning properties on landing tend to be decreased.

As shown in Japanese patent application laying-open publication No. 11-346803, Mizuno Corporation proposed a midsole structure in which a plurality of through holes or cushion holes are formed in a midsole having a corrugated sheet therein. In this case, since vertical deformation of the midsole is easy to occur at regions where the cushion holes are formed, the cushioning properties on landing are improved.

However, in this case, when a cushion hole having a greater diameter is used to further improve cushioning properties of the midsole, a midsole portion having a cushion hole formed therein is easy to lose its elasticity and during a prolonged use, cushioning properties of the midsole will be conversely lowered.

An object of the present invention is to provide a midsole structure of an athletic shoe that can prevent loss of elasticity of a midsole at regions where cushion holes are formed and that can improve durability of the midsole at regions having cushion holes formed therein. Another object of the present invention is to enhance flexural rigidity of a midfoot portion and to improve flexibility or bendability of a forefoot portion of an athletic shoe.

SUMMARY OF THE INVENTION

A midsole structure of an athletic shoe according to one embodiment of the present invention includes an upper midsole formed of a soft elastic material and extending from a heel region to a forefoot region through a midfoot region, a lower midsole formed of a soft elastic material and disposed at least at the heel region and the forefoot region under the upper midsole, a first corrugated sheet disposed between the upper and lower midsoles, and a second corrugated sheet disposed opposite to the first corrugated sheet between the upper and lower midsoles and having a corrugated surface that forms a laterally extending through hole with the first corrugated sheet.

In this case, since the first and second corrugated sheets are provided between the upper and lower midsoles, the heel region of the shoe is prevented from deforming laterally, thereby securing running stability. Also, since the through hole is formed between the upper and lower midsoles as a cushion hole, the midsole is easy to deform in the vertical direction at regions where the through hole is formed, thereby securing cushioning properties at the time of landing.

Furthermore, in this embodiment, the through hole is formed of corrugated surfaces of the first and second corrugated sheets. That is, in this case, edge portions of an opening and inner circumference of the through hole are reinforced by the corrugated sheets. In other words, through-hole-formed regions of the upper and lower midsoles are reinforced by the corrugated sheets. Thus, even when a shoe with a through hole of a greater diameter is used during a prolonged period, loss of elasticity or permanent set in fatigue of the through-hole-formed regions of the midsole can be prevented and durability of the through-hole-formed regions of the midsole improve. Also, because the diameter of a through hole can be made larger, lightening of the weight of the whole midsole can be promoted.

In another embodiment, since the through hole is formed at the shoe heel region, cushioning properties on landing at the shoe heel region can be improved.

In a still another embodiment, since the through hole is formed at the shoe midfoot region, cushioning properties on landing at the shoe midfoot region can be improved. Also, the through hole has an oblong and elongated shape (in a shoe elongated direction) in cross section, and the corrugated surfaces of the first and second corrugated sheets are provided along the elongated shape of the through hole. Thus, the through hole of such an elongated shape exercises a so-called "shank effect", and flexural rigidity of the shoe midfoot region or shank portion increases. Thereby, flexibility or bendability of the shoe midfoot region decreases and as a result, flexibility or bendability of the shoe forefoot portion can be relatively improved. Moreover, in this case, torsional rigidity of the shoe midfoot portion can be set at a higher value, thereby restraining torsional deformation of the shoe midfoot region during activities.

The through hole may have a generally fusiform cross section. Such a through hole is formed of a concavely curved surface at a crest portion of a wavy corrugation of an upper corrugated sheet and a concavely curved surface at a trough portion of a wavy corrugation of a lower corrugated sheet.

The through hole may have a generally eyebrow-shaped cross section. Such a through hole is formed of a concavely curved surface at a crest portion of a wavy corrugation of an upper corrugated sheet and a convexly curved surface at a crest portion of a wavy corrugation of a lower corrugated sheet. In this case, a radius of curvature of the convexly curved surface at the crest portion of the lower corrugated sheet is greater than a radius of curvature of the concavely curved surface at the crest portion of the upper corrugated sheet. Alternatively, such a through hole is formed of a convexly curved surface at a trough portion of a wavy corrugation of an upper corrugated sheet and a concavely curved surface at a trough portion of a wavy corrugation of a lower corrugated sheet. In this case, a radius of curvature of the convexly curved surface at the trough portion of the upper corrugated sheet is greater than a radius of curvature of the concavely curved surface at the trough portion of the lower corrugated sheet.

The through hole may have a generally oval cross section. In the alternative, the through hole may have a concavely curved surface at the crest portion of a wavy corrugation of a first (or a second) corrugated sheet on the side of the upper midsole.

In these cases, when an upper surface of the through hole is formed of a concavely curved surface of a crest portion of an upper corrugated sheet, flexural rigidity of the shoe midfoot region can be remarkably increased. This results because the concavely curved surface is bent in a direction opposite the bending direction of the shoe midsole region when a force is applied to the shoe so as to bend the shoe midsole region upwardly. In such a manner, flexibility or bendability of the shoe midfoot region can be remarkably decreased, and as a result, flexibility or bendability of the shoe forefoot region can be further improved.

In a further embodiment, a first corrugated sheet extends from the heel portion to the forefoot portion on the side of the lower midsole and a second corrugated sheet extends from the heel portion to the midfoot portion on the side of the upper midsole and through holes are formed at the shoe heel and midfoot regions.

In this case, since the first corrugated sheet extends to the forefoot portion of the upper midsole, the shoe forefoot region is easy to bend along a crest or trough portion of a wavy corrugation of the first corrugated sheet, thereby further improving flexibility or bendability of the shoe forefoot region.

In a still further embodiment, a through hole formed at the shoe midfoot region has an oblong and elongated shape in cross section and corrugated surfaces of a first and second corrugated sheet are provided along the elongated shape of the through hole. Thus, the through hole of such an elongated shape develops a so-called "shank effect", and flexural rigidity of the shoe midfoot region or shank portion increases. Thereby, flexibility or bendability of the shoe midfoot region decreases and as a result, flexibility or bendability of the shoe forefoot portion can be relatively improved. Moreover, in this case, torsional rigidity of the shoe midfoot portion can be set at a higher value, thereby restraining torsional deformation of the shoe midfoot region during activities.

The shoe forefoot portion may also have a through hole, which improves cushioning properties of the shoe forefoot portion.

In an additional embodiment, a first or second corrugated sheet has a pair of flange portions extending upwardly and/or downwardly on both edges of a medial side and a lateral side. In this case, since the flange portions are disposed at opposite ends of the upper and/or lower midsole, lateral or transverse deformation of the midsole can be restrained by the flange portions. Thereby, running stability of the shoe is further increased.

BRIEF DESCRIPTION OF THE DRAWINGS

For a more complete understanding of the invention, reference should be made to the embodiments illustrated in greater detail in the accompanying drawings and described below by way of examples of the invention. In the drawings, which are not to scale.

DETAILED DESCRIPTION OF THE PREFERRED EMBODIMENTS

Figure 1:
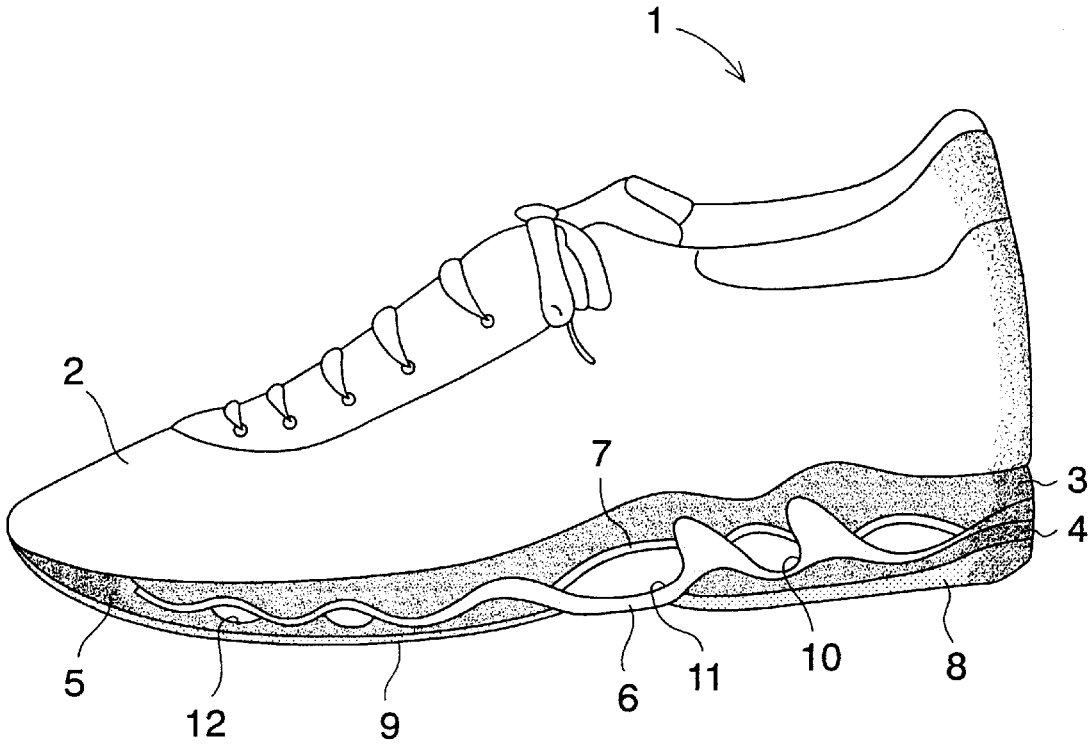
FIG. 1 is a lateral side view of a left athletic shoe incorporating a midsole structure of one embodiment of the present invention.
Figure 2:
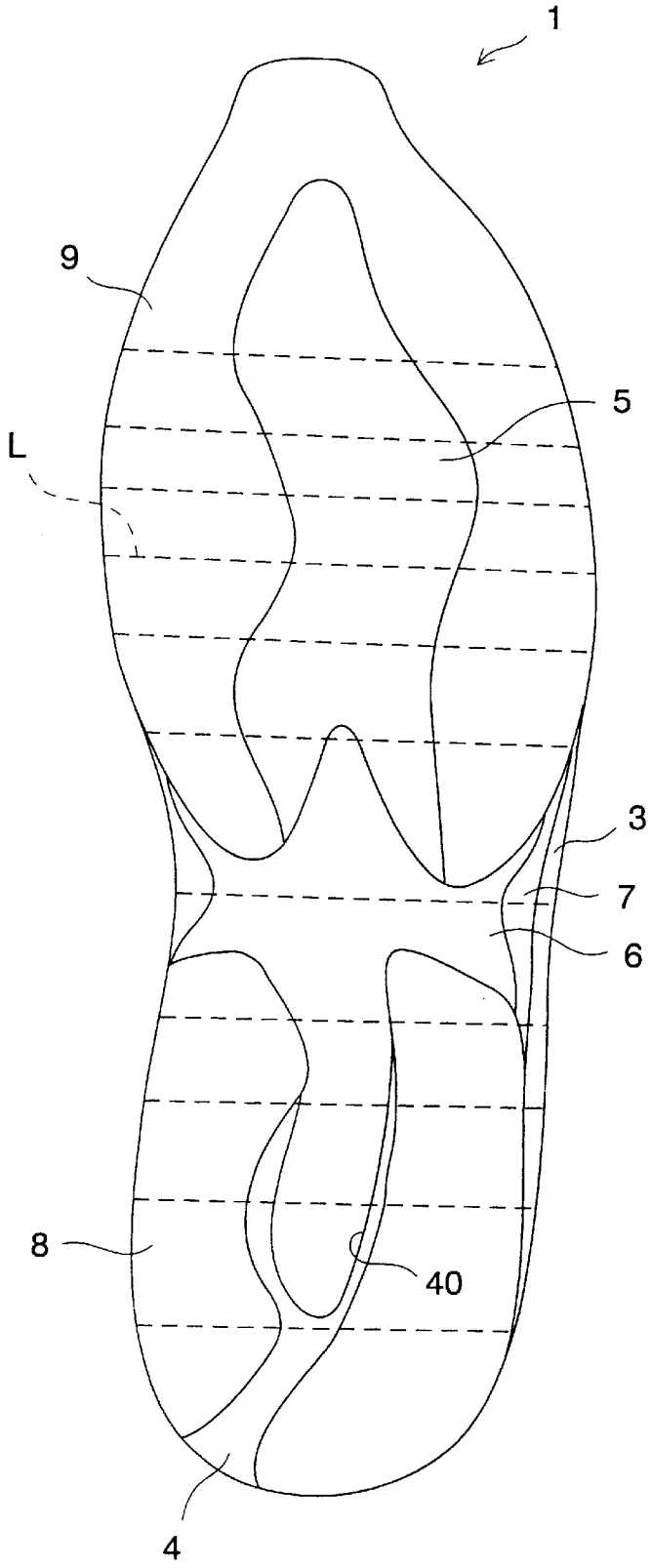
FIG. 2 is a bottom view of the athletic shoe of FIG. 1.

As shown in FIGS. 1 and 2, a sole of an athletic shoe 1 includes an upper midsole 3 extending from a heel region to a forefoot region through a midfoot region (or a plantar arch portion) of the shoe and fitted to a lower part of an upper 2, lower midsoles 4 and 5 provided respectively at the heel region and the forefoot region of the shoe under the upper midsole 3, first and second corrugated sheets 6 and 7 disposed opposite each other between the upper midsole 3 and the lower midsoles 4, 5 and each having a wavy corrugation, and outsoles 8 and 9 fitted under the lower midsoles 4, 5 and directly contacting the ground.

The upper midsole 3 and the lower midsoles 4, 5 are provided in order to relieve a shock applied to the bottom portion of the shoe 1 at the time of striking onto the ground. Each of the midsoles 3–5 is generally formed of a soft elastic material having good cushioning properties. Specifically, thermoplastic synthetic resin foam such as ethylene-vinyl acetate copolymer (EVA), thermosetting resin foam such as polyurethane (PU), or rubber material foam such as butadiene or chloroprene rubber is used.

Each of the corrugated sheets 6, 7 is preferably formed of thermoplastic resin such as thermoplastic polyurethane (TPU) of comparatively rich elasticity, polyamide elastomer (PAE), ABS resin or the like. Alternatively, each of the corrugated sheets 6, 7 is formed of thermosetting resin such as epoxy resin, unsaturated polyester resin and the like.

Wavy corrugated surfaces of the first and second corrugated sheets 6, 7 form a through hole 10 at the shoe heel region and a through hole 11 at the shoe midfoot region, respectively. Also, a plurality of through holes 12 are formed in the lower midsole 5 at the shoe forefoot region. These through holes 10, 11 and 12 are provided as cushion holes to enhance cushioning properties of the midsole.

Figure 3:
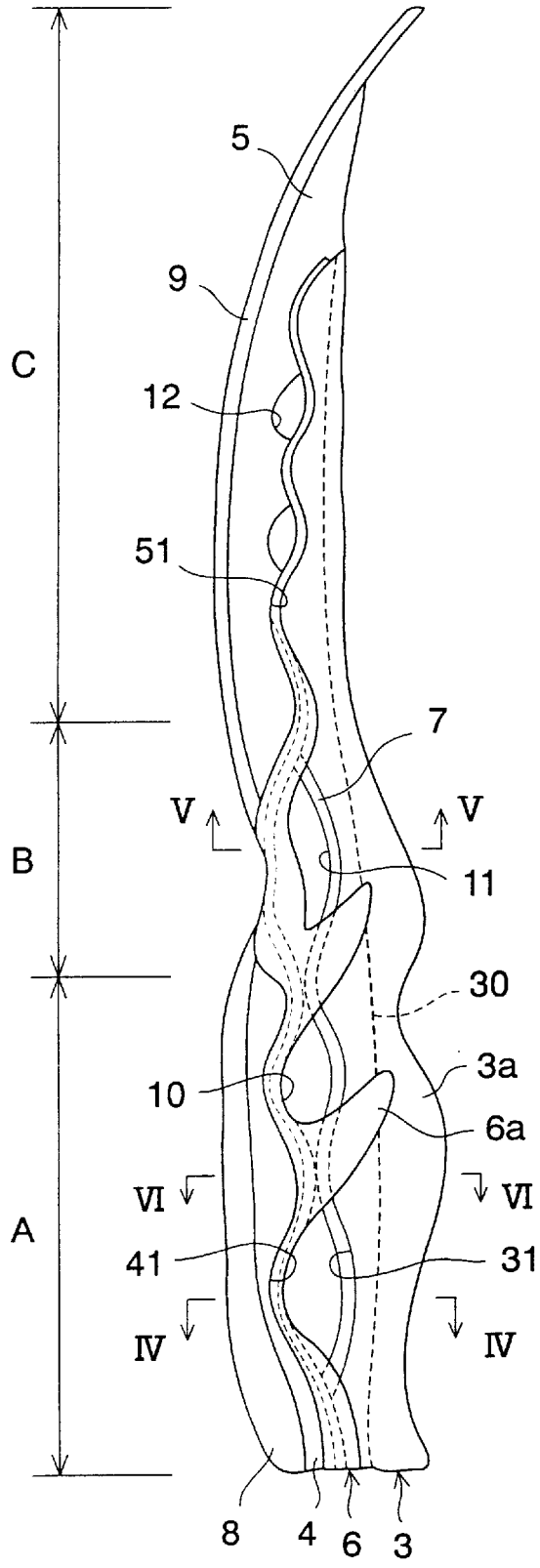
FIG. 3 is a lateral side view of the midsole structure of FIG. 1.

As shown in FIG. 3, the upper midsole 3 is formed of a heel portion A, a midfoot portion B, and a forefoot portion C, each corresponding to the heel region, midfoot region, and forefoot region of the shoe. The lower midsole 4 is disposed under the heel portion A of the upper midsole 3, and the lower midsole 5 is disposed under the forefoot portion C of the upper midsole 3.

Figure 4:
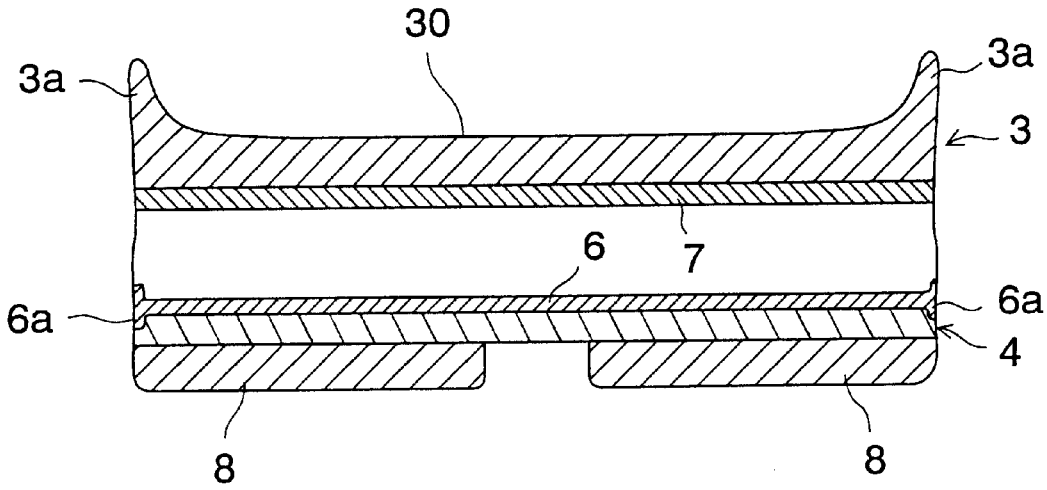
FIG. 4 is a cross sectional view of FIG. 3 taken along line IV—IV.
Figure 5:
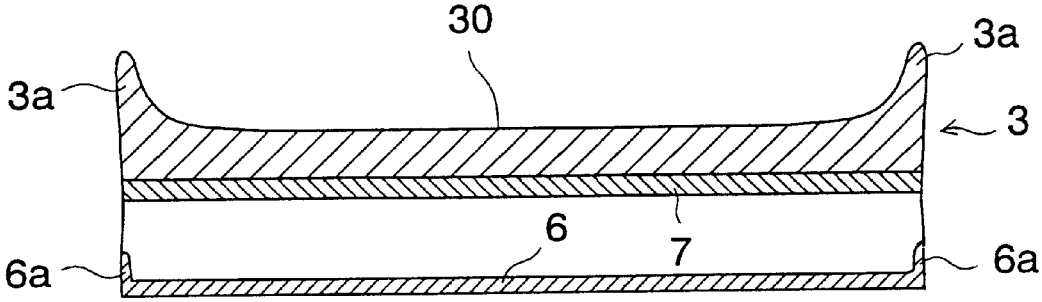
FIG. 5 is a cross sectional view of FIG. 3 taken along line V—V.
Figure 6:
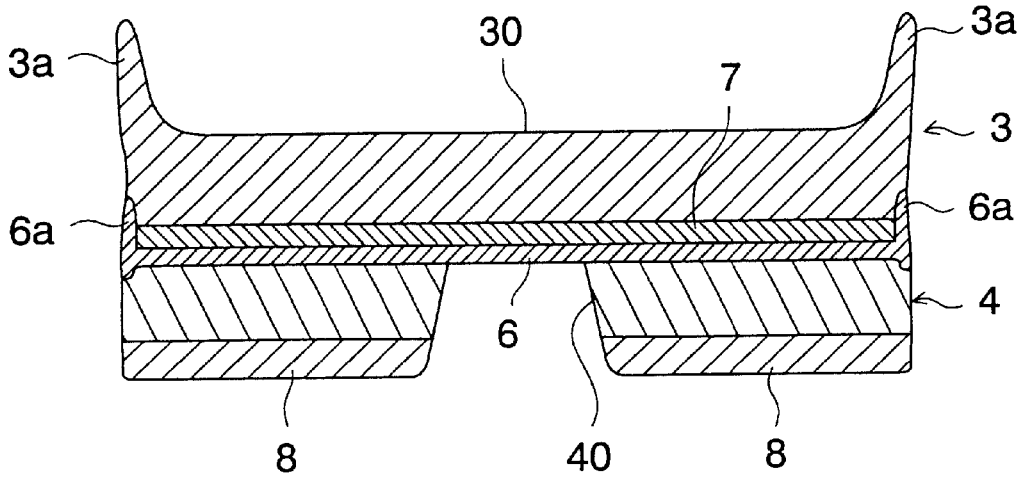
FIG. 6 is a cross sectional view of FIG. 3 taken along line VI—VI.

As shown in FIGS. 4 to 6, the upper midsole 3 includes a base surface 30 to which the bottom portion of the upper 2 is attached and a pair of upraised portions 3*a* extending upwardly from the both edges of the base surface 30.

As shown in FIG. 3, the bottom surface of the upper midsole 3 has a wavy corrugated surface 31 extending from the heel portion A to the forefoot portion C through the midfoot portion B. The second corrugated sheet 7 is attached to the regions of the wavy corrugated surface 31 extending from the heel portion A to the midfoot portion B. Also, a wavy corrugated surface of the forefoot portion of the first corrugated sheet 6 is attached to the wavy corrugated surface 31 at the forefoot portion C of the upper midsole 3.

An upper surface of the lower midsole 4 has a wavy corrugated surface 41, and similarly, an upper surface of the lower midsole 5 has a wavy corrugated surface 51. Wavy corrugated surfaces of the heel and forefoot portions of the first corrugated sheet 6 are attached to the wavy corrugated surfaces 41, 51. In addition, as shown in FIGS. 2 and 6, a vertically extending hole 40 is formed at a central portion of the lower midsole 4.

The first corrugated sheet 6 extends from the heel portion A to the forefoot portion C through the midfoot portion B of the upper midsole 3. As shown in FIGS. 4 to 6, the first corrugated sheet 6 has a pair of flange portions 6*a* extending upwardly and downwardly at opposite ends thereof. These flange portions 6*a* act to restrain the upper and lower midsoles 3, 4 from deforming laterally or transversely. Similar flange portions may also be provided at the second corrugated sheet 7. In FIG. 3, sheet portions of the first corrugated sheet 6 other than the flanges 6*a* are shown in a dotted line. In FIG. 2, dotted lines L extending in a shoe width direction indicate crest lines or trough lines of wavy corrugations of the first corrugated sheet 6.

The second corrugated sheet 7 extends from the heel portion A to the midfoot portion B of the upper midsole 3. As shown in FIG. 6, the second corrugated sheet 7 is disposed opposite the first corrugated sheet 6 and trough portions of wavy corrugations thereof contact crest portions of wavy corrugations of the first corrugated sheet 6.

Each of the through holes 10, 11 formed at the shoe heel and midfoot regions is defined by a concavely curved surface at a trough portion of a wavy corrugation of the first corrugated sheet 6 and a concavely curved surface at a crest portion of a wavy corrugation of the second corrugated sheet 7. Therefore, the through holes 10, 11 extend in the shoe width direction along a crest line and a trough line of the first and second corrugated sheets 6, 7. Also, each of the through holes 10, 11 has a generally fusiform cross section, but other cross sectional shapes may be employed.

For example, a generally eyebrow-shaped cross section may be employed. In this case, a through hole is defined by a concavely curved surface at a trough portion of a wavy corrugation of the first corrugated sheet 6 and a convexly curved surface at a trough portion of a wavy corrugation of the second corrugated sheet 7. In the alternative, a generally oval cross section may be employed as a through hole. In either case, the through hole 11 preferably has an oblong and elongated shape in cross section.

According to this embodiment, since the first and second corrugated sheets 6 and 7 are provided between the upper and lower midsoles 3 and 4, lateral or transverse deformation of the shoe heel region to the shoe forefoot region can be prevented, and thus, running stability can be secured. Also, since the through holes 10, 11 and 12 as cushion holes are formed between the upper and lower midsoles 3, 4, the midsole is easy to deform in the vertical direction at portions where the through holes are formed, and thus, cushioning properties on landing can be secured at the shoe heel region to the shoe forefoot region.

Furthermore, in this case, the through holes 10, 11 are formed of wavy corrugated surfaces of the first and second corrugated sheets 6, 7. That is, opening edges and inner circumferences of the through holes 10, 11 are reinforced by the corrugated sheets 6, 7. In other words, through-hole-formed portions of the upper and lower midsoles 3, 4 are reinforced by the corrugated sheets 6, 7.

Thus, even when a shoe with through holes 10, 11 having increased sizes in the longitudinal and vertical directions is used during a prolonged period, loss of elasticity or permanent set in fatigue of the through-hole-formed regions of the upper and lower midsoles 3, 4 can be prevented, and durability of through-hole-formed regions of the upper and lower midsoles 3, 4 improves. Also, since the diameter of the through holes 10, 11 can be made larger, weight-lightening of the entire midsole can be promoted. Furthermore, by increasing the size of the through holes 10, 11, vertical deformation of the corrugated sheets 6, 7 and the upper and lower midsoles 3, 4 can be made larger, which further improves cushioning properties of the shoe.

Moreover, in this case, the through hole 11 formed at the shoe midfoot region has an oblong and elongated shape, and the opening edges and the inner circumference of the elongated through hole 11 are formed of the wavy corrugated surfaces of the first and second corrugated sheets 6, 7. Thus, the through hole 11 of such an elongated shape develops a so-called "shank effect", and flexural rigidity of the shoe midfoot region or shank portion increases. Thereby, flexibility or bendability of the shoe midfoot region decreases and as a result, flexibility or bendability of the shoe forefoot portion can be relatively improved. Moreover, in this case, torsional rigidity of the shoe midfoot portion can be set at a higher value, thereby restraining torsional deformation of the shoe midfoot region during activities.

Also, in this case, since an upper surface of the through hole 11 is formed of a concavely curved surface of a crest portion of the second corrugated sheet 7, flexural rigidity of the shoe midsole region can be remarkably increased. This results because the concavely curved surface is curved in a direction opposite the bending direction of the shoe midfoot region when a force is applied to the shoe so as to bend the shoe midfoot region upwardly. In such a manner, flexibility or bendability of the shoe midfoot region can be remarkably decreased, and as a result, flexibility or bendability of the shoe forefoot region can be further improved.

In addition, since the first corrugated sheet 6 extends to the forefoot portion C of the upper midsole 3, the shoe forefoot region is easy to bend along a crest or trough portion of a wavy corrugation of the first corrugated sheet 6, thereby further improving flexibility or bendability of the shoe forefoot region.

Those skilled in the art to which the invention pertains may make modifications and other embodiments employing the principles of this invention without departing from its spirit or essential characteristics particularly upon considering the foregoing teachings. The described embodiments and examples are to be considered in all respects only as illustrative and not restrictive. The scope of the invention is, therefore, indicated by the appended claims rather than by the foregoing description. Consequently, while the invention has been described with reference to particular embodiments and examples, modifications of structure, sequence, materials and the like would be apparent to those skilled in the art, yet fall within the scope of the invention.

What is claimed is:

1. A midsole structure of an athletic shoe comprising:

an upper midsole formed of a soft elastic material and having an upper midsole heel portion, an upper midsole midfoot portion and an upper midsole forefoot portion that correspond to a heel region, a midfoot region and a forefoot region of said shoe, respectively;

a lower midsole that is disposed at least at said heel region and said forefoot region of said shoe under said upper midsole and that is formed of a soft elastic material and that has a lower midsole heel portion and a lower midsole forefoot portion;

a first corrugated sheet that has a first corrugated surface with first corrugation crests and troughs respectively extending along first crest and trough lines, and that is disposed between said upper midsole and said lower midsole; and a second corrugated sheet that is disposed against said first corrugated sheet between said upper midsole and said lower midsole, and that has a second corrugated surface with second corrugation crests and troughs respectively extending along second crest and trough lines, wherein said second corrugated sheet contacts said first corrugated sheet at least at partial surface areas of said second corrugated surface contacting partial surface areas of said first corrugated surface, and wherein at least one through hole is formed between said first corrugated surface and said second corrugated surface, said through hole extending respectively along one of said first crest or trough lines of said first corrugated surface of said first corrugated sheet.

2. The midsole structure of claim 1, wherein said at least one through hole comprises a through hole disposed at said heel region of said shoe.

3. The midsole structure of claim 1, wherein said at least one through hole comprises a through hole that is disposed at said midfoot region and that has an oblong and elongated shape in cross section.

4. The midsole structure of claim 3, wherein said through hole has a generally fusiform cross section.

5. The midsole structure of claim 3, wherein said through hole has a cross section having a concavely curved boundary and a convexly curved boundary opposite each other.

6. The midsole structure of claim 3, wherein said through hole has a generally oval cross section.

7. The midsole structure of claim 3, wherein said through hole has a concavely curved surface at one of said first or second corrugation crests of said first or second corrugated surface of said first or second corrugated sheet which is arranged proximate to said upper midsole.

8. The midsole structure of claim 1, wherein said first corrugated sheet is disposed adjoining said lower midsole and extends from said lower midsole heel portion to said lower midsole forefoot portion through said midfoot region of said shoe, said second corrugated sheet is disposed adjoining said upper midsole and extends from said upper midsole heel portion to said upper midsole midfoot portion, and said at least one through hole comprises a first through hole formed at said heel region and a second through hole formed at said midfoot region of said shoe.

9. The midsole structure of claim 8, wherein said second through hole formed at said midfoot region of said shoe has an oblong and elongated shape in cross section.

10. The midsole structure of claim 9, wherein said second through hole has a generally fusiform cross section.

11. The midsole structure of claim 9, wherein said second through hole has a cross section having a concavely curved boundary and a convexly curved boundary opposite each other.

12. The midsole structure of claim 9, wherein said second through hole has a generally oval cross section.

13. The midsole structure of claim 9, wherein said second through hole has a concavely curved surface at one of said second corrugation crests of said second corrugated surface of said second corrugated sheet which adjoins said upper midsole.

14. The midsole structure of claim 8, wherein said at least one through hole further comprises a third through hole formed at said forefoot region of said shoe.

15. The midsole structure of claim 1, wherein said first corrugated sheet or said second corrugated sheet has a flange portion at opposite edges thereof on a medial side and a lateral side, wherein said flange portion extends either upwardly or downwardly.

16. The midsole structure of claim 1, wherein said upper midsole has a corrugated lower surface, said second corrugated sheet is arranged contacting and extending surfacially along said corrugated lower surface and is corrugated corresponding to said corrugated lower surface, said lower midsole has a corrugated upper surface, and said first corrugated sheet is arranged contacting and extending surfacially along said corrugated upper surface and is corrugated corresponding to said corrugated upper surface.

17. The midsole structure of claim 1, wherein said first and second corrugated sheets are arranged entirely with said first corrugation crests and troughs out of phase with said second corrugation crests and troughs.

18. A midsole structure of an athletic shoe comprising:

an upper midsole formed of a soft elastic material and having an upper midsole heel portion, an upper midsole midsole portion and an upper midsole forefoot portion that corresponds to a heel region, a midfoot region and a forefoot region of said shoe, respectively;

a lower midsole that is disposed at least at said heel region and said forefoot region of said shoe under said upper midsole and that is formed of a soft elastic material and that has a lower midsole heel portion and a lower midsole forefoot portion;

a first corrugated sheet having a first corrugated surface and disposed between said upper midsole and said lower midsole; and a second corrugated sheet that is disposed against said first corrugated sheet between said upper midsole and said lower midsole and that has a second corrugated surface forming a through hole with said first corrugated surface of said first corrugated sheet, said through hole extending along a crest or trough line of said first corrugated surface of said first corrugated sheet;

wherein said first corrugated sheet or said second corrugated sheet has a respective flange portion at opposite edges thereof on a medial side and a lateral side, wherein said flange portion extends either upwardly or downwardly.

* * * * *